US005228175A

United States Patent [19]

Olry et al.

[11] Patent Number: 5,228,175

[45] Date of Patent: Jul. 20, 1993

[54] PROCESS FOR THE MANUFACTURE OF A FIBROUS PREFORM FORMED OF REFRACTORY FIBERS FOR PRODUCING A COMPOSITE MATERIAL ARTICLE

[75] Inventors: Pierre Olry, Bordeaux; Dominique Coupé, Le Haillan, both of France

[73] Assignee: Societe Europeenne De Propulsion, Sureness, France

[21] Appl. No.: 801,700

[22] Filed: Dec. 2, 1991

[30] Foreign Application Priority Data

Dec. 3, 1990 [FR] France ..... 90 15128

[51] Int. Cl.[5] ..... D06H 7/22

[52] U.S. Cl. ..... 28/168; 28/170; 28/112

[58] Field of Search ..... 28/107, 112, 165, 168, 28/170, 109, 166, 167, 169; 19/0.35; 87/1, 5; 428/370; 139/426 R; 57/7, 295; 156/148, 149, 155

[56] References Cited

U.S. PATENT DOCUMENTS

| | | | |
|---|---|---|---|
| 3,994,762 | 11/1976 | Wrzesien et al. | 28/112 |
| 4,482,601 | 11/1984 | Hartigan, Jr. | 28/107 |
| 4,825,635 | 5/1989 | Guevel et al. | 57/200 |
| 4,885,973 | 12/1989 | Spain | 28/170 |

FOREIGN PATENT DOCUMENTS

| | | | |
|---|---|---|---|
| 2608641 | 6/1988 | France . | |
| 7316144 | 5/1973 | Japan | 28/168 |
| 2210036 | 8/1990 | Japan . | |
| 2021660 | 12/1979 | United Kingdom . | |

OTHER PUBLICATIONS

Japanese Patents Gazette Section Ch. Week 8329, 11 Jun. 1983, Derwent Publications Limited, London.

*Primary Examiner*—Clifford D. Crowder
*Assistant Examiner*—Amy Brooke Vanatta
*Attorney, Agent, or Firm*—Weingarten, Schurgin, Gagnebin & Hayes

[57] ABSTRACT

A fibrous preform is formed from a yarn composed of long discontinuous fibers made of a refractory material or its precursor. The discontinuous fibers are disposed parallel to one another without twist, and the integrity of the yarn is achieved by a covering yarn made of a fugitive material. The fibrous preform is intended to be densified by a matrix material for the manufacture of a composite material article. The covering yarn is eliminated before the preform is densified by the matrix material.

7 Claims, No Drawings

PROCESS FOR THE MANUFACTURE OF A FIBROUS PREFORM FORMED OF REFRACTORY FIBERS FOR PRODUCING A COMPOSITE MATERIAL ARTICLE

FIELD OF THE INVENTION

The invention relates to the manufacture of fibrous preforms formed of refractory fibers for producing composite material articles. The invention also relates to a composite yarn suitable for the manufacture of such preforms.

Refractory fibers are understood to encompass carbon fibers and ceramic fibers. Among the latter are carbide, nitride or refractory oxide fibers, such as those made of silicon carbide or silicon nitride, or boron carbide, alumina, etc..

Precursors of refractory fibers are understood to mean fibers in a state prior to a refractory state, the transition to the latter state usually being obtained by heat treatment. For example, a precursor of carbon would be preoxidized polyacrylonitrile (PAN), or pitch, while a precursor of silicon carbide would be polycarbosilane (PCS).

One particular application of the present invention is in the manufacture of composite material components composed of a refractory fibrous preform that is densified by a matrix. Densification consists in the deposition or infiltration of the matrix material into the porosity of the preform throughout the volume thereof.

PRIOR ART

Various processes are known for obtaining a preform made of refractory fibers. One classical process consists in superposing plies composed of two-dimensional fibrous texture, usually a cloth, the plies being in some cases bound together, e.g. by needling.

One difficulty encountered with known refractory fibers resides in their poor ability to undergo textile forming operation, such as weaving, notably in the case of ceramic fibers, and especially as regards needling.

One way of overcoming this difficulty consists in conducting all the necessary textile-forming operations on yarns whose constituent fibers are in the precursor state, where they are more apt to undergo these operations. The transformation of the precursor into a refractory material is then performed after carrying out the textile operations.

Another way of overcoming this difficulty, when needling superposed plies of a carbon fiber cloth, consists in interposing layers of felt between the plies. When using a cloth formed from yarns in which the cohesion of the carbon fibers is ensured by twisting the penetration of the yarns by the needling action has more the effect of breaking the fibers than detaching the fibers to allow implantation across the plies. Accordingly, the interposed felt layers are provided to serve as a source of fibers capable of being drawn along by the needling action.

A further problem encountered i the manufacture of composite material articles concerns the accessibility of the internal pores of the preform during densification.

Different densification techniques are known, such as resin densification and chemical vapor deposition or infiltration.

Resin densification consists in impregnating the preform with a liquid containing a precursor of the material forming the matrix and then transforming the precursor, usually through a heat treatment. Usually the precursor is a polymer which is cured and pyrolysed to obtain the matrix material. The process including impregnation, curing and pyrolysis may be carried out several times.

Chemical vapor deposition or infiltration involves placing the preform in an enclosure into which a gaseous flow is introduced under predetermined temperature and pressure conditions. The gaseous flow thus forms the matrix material upon contact with the fibers of the preform, though a decomposition of one or several its constituents, or by a reaction between its constituents.

Whatever the technique used, it is impossible in practice to obtain a complete densification of the preform. The reason is that some of the volumes that the yarns define between themselves include "dead" volumes. These "dead" volumes cannot be densified, even if a chemical vapor infiltration process is used, their restricted access, if at all present, becoming rapidly obtructed.

SUMMARY OF THE INVENTION WITH OBJECTS

It is an object of the present invention to provide a process for the manufacture of a fibrous preform of refractory fibers which may include the carrying out of different types of textile operations, including needling.

It is also an object of the present invention to provide a process for the manufacture of fibrous preforms having practically no "dead" volumes and therefore capable of being easily densified.

According to the invention, a process for the manufacture of a fibrous preform formed of refractory fibers includes the steps of:

providing a yarn essentially composed of discontinuous fibers made of a refractory material or a precursor thereof, with the discontinuous fibers being disposed parallel to one another, without twist, and the integrity of the yarn being achieved by a covering yarn made of a fugitive material,

- forming a fibrous preform from said yarn composed of parallel discontinuous fibers and a covering yarn, and eliminating said covering yarn to allow said discontinuous fibers to loosen within the bulk of said preform.

Preferably, the covering yarn has a low denier compared with that of the assembly of discontinuous fibers in order not to leave too important voids within the preform after elimination of the covering yarn. The denier of the covering yarn is preferably less than one tenth of that of the assembly of discontinuous fibers.

The covering yarn is made of a fugitive material which is to be understood as encompassing any material capable of being eliminated without leaving any residue, and without causing an alteration of the refractory fibers. For instance, the fugitive material can be a soluble polymer, such as PVA (polyvinyl alcohol), or a polymer capable of being totally eliminated by a heat treatment, such as polyvinyl acetate or polyethylene.

The step of providing a yarn in the process according to the invention involves obtaining discontinuous fibers, preferably long discontinuous fibers, that are parallel to one another and made of a refractory material or a precursor thereof. Such a step may be achieved e.g. by controlled stretch-breaking of a multi-filament tow cable, as described in document FR-A-2 608 641, whereby fibers having an average length of between 100 and 120 mm (about 4 to 5 inches) can be obtained.

In the aforementioned document, the fibers are transformed into a yarn by a twist carried out on a standard spinning apparatus.

In contrast, the fibers that make up the yarn used in the present invention are left parallel to each other, and not twisted, the integrity of the yarn being achieved by covering the fibers with a covering yarn. This covering can be obtained by means of a known yarn covering machine, such as the "Parafil" machine produced by Spindelfabrik Suessen of Germany.

The covering of the yarn provides the necessary resistance in view of the textile operations, and weaving in particular.

After elimination of the covering yarn, the presence of discontinuous parallel fibers in an untwisted state allows the needling to be conducted by taking some of these fibers with the needles, without relying on a felt-like texture to provide the fibers susceptible of being drawn along by the needles.

Accordingly, the process according to the present invention may be used in all applications that require textile operations on the yarn, such as needling and weaving.

The process according to the invention has the added advantage of making it possible to eliminate the "dead" volumes that are not completely densifiable. Indeed, once the preform has been made and the covering yarn eliminated, the loosened fibers have a tendency to occupy the available volumes as a result of a "swelling" of the yarn. This enables the porosity of the preform to be more easily and more uniformly accessible to the matrix material. This results in a more complete densification and a reduced inhomogeneity of the composite material.

When the yarn used for producing a preform is made of a precursor of the intended refractory material, the transformation of the precursor into a refractory material is conducted after the preform is produced and after elimination of the covering yarn. When the covering yarn is made of a material capable of being eliminated by heat, the elimination can be obtained during a raising in temperature carried out in view of transforming the precursor by a heat treatment.

DETAILED DESCRIPTION OF THE PREFERRED EMBODIMENTS

The specific examples explaining the manufacture of fibrous preforms according to the present invention that now follow are given purely as a non-limiting indication.

EXAMPLE 1

Manufacture of a preform made of carbon fibers

A two-dimensional (2D) texture is formed by weaving a yarn made of non-twisted pre-oxidized PAN (polyacrylonitrile) fibers covered with a PVA (poly vinyl alcohol) yarn. The characteristics of the 2D cloth are as follows:

| | |
|---|---|
| yield of the pre-oxidized PAN yarn | 500 tex |
| yield of the PVA covering yarn | 45 dtex |
| weaving contexture | 8 satin |
| count of warp directions | 10/cm |
| count of weft directions | 10/cm |
| weight | 1050 g/m$^2$ |

After weaving, the cloth is washed in a bath of water at 80° C. for a period of 10 mm and then dried. The PVA covering yarn is completely dissolved and the fibers forming the pre-oxidized PAN yarn expand within the cloth, allowing the latter to be needled directly, without need for a felt layer.

Several layers are then superposed and needled to form a fibrous preform. The latter is then submitted to a thermal treatment (carbonisation) to transform the pre-oxidized PAN into carbon. A fibrous preform composed of carbon fibers is obtained. The above-described cloth makes it possible to obtain a needled preform in which the volume ratio of the carbon fibers is around 30% (percentage of the preform's apparent volume effectively occupied by the fibers).

The carbon fiber preform can then be densified by a material composing the matrix, such as carbon or ceramic, in order to produce the desired composite material article with a carbon fiber reinforcement. The densification is obtained by resin densification or by chemical vapor infiltration. The swelling of the yarns within the fibrous texture, resulting from the relaxation of the untwisted fibers after elimination of the covering yarn, prevents the formation of "dead" volumes within the preform and consequently contributes to a more complete and homogeneous densification.

EXAMPLE 2

Manufacture of a preform made of ceramic fibers

A texture is formed by a multi-layer weaving of a yarn composed of untwisted silicon carbide (SiC) fibers covered with a PVA yarn. The characteristics of the cloth are as follows:

| | |
|---|---|
| yield of the SiC yarn | 330 tex |
| yield of the PVA covering yarn | 45 dtex |
| weaving contexture | Interlock |
| number of layers | 5 |
| count of warp directions | 40/cm |
| count of weft directions | 30/cm |
| thickness of cloth | 3 mm |

After weaving, the texture is soaked in a bath of water at 80° C. for a period of 15 minutes and then dried. It is observed that the PVA yarn is dissolved and that the SiC fibers expand within the texture. The fiber volume ratio of in the woven texture as indicated above is around 30%.

As explained with reference to example 1, the resulting texture is particularly suitable to be subsequently densified.

The invention is not limited to the above examples.

A preform made of carbon fibers may be manufactured starting directly from carbon fibers, including high strength carbon fibers.

Also, a preform made of ceramic fibers, such as SiC fibers may be manufactured starting from a SiC precursor, such as polycarbosilane (PCS).

We claim:

1. A process for the manufacture of a fibrous preform formed of refractory fibers for producing a composite material article, said process comprising the steps of:

providing a yarn comprising:

discontinuous fibers made of a refractory material or a precursor thereof, with the discontinuous fibers being disposed parallel to one another, without twist, and a covering yarn made of a fugitive material over the discontinuous fibers to provide integrity to the yarn;

forming a fibrous preform from said yarn composed of parallel discontinuous fibers and a covering yarn; and eliminating said covering yarn to allow said discontinuous fibers to loosen within the bulk of said preform.

2. A process according to claim 1, wherein said covering yarn has a denier less than one tenth of that of the assembly of discontinuous fibers.

3. A process according to claim 1, wherein said discontinuous fibers are obtained by a controlled stretch breaking process.

4. A process according to claim 1, wherein said covering yarn is made of a soluble polymer.

5. A process according to claim 1, wherein said covering yarn is made of a material capable of being eliminated by heat.

6. A process according to claim 1, wherein said yarn is essentially composed of discontinuous fibers made of a precursor of a refractory material, and the transformation of said precursor into said refractory material is carried out after the step of eliminating said covering yarn.

7. A process according to claim 1, further comprising a needling step carried out on said fibrous preform after the step of eliminating said covering yarn.

* * * * *

UNITED STATES PATENT AND TRADEMARK OFFICE

CERTIFICATE OF CORRECTION

PATENT NO. : 5,228,175

DATED : July 20, 1993

INVENTOR(S) : Pierre Olry, et al

It is certified that error appears in the above-indentified patent and that said Letters Patent is hereby corrected as shown below:

Column 1, line 60, "i the" should read --in the--.

Column 4, line 6, "10 mm" should read --10 mn--.

Signed and Sealed this

Twelfth Day of July, 1994

Bruce Lehman

*Attest:*

BRUCE LEHMAN

*Attesting Officer*

*Commissioner of Patents and Trademarks*